US005656419A

United States Patent [19]

Toya et al.

[11] Patent Number: 5,656,419

[45] Date of Patent: Aug. 12, 1997

[54] HEAT-DEVELOPABLE PHOTOGRAPHIC LIGHT-SENSITIVE MATERIAL

[75] Inventors: Ichizo Toya; Hisashi Okada, both of Kanagawa, Japan

[73] Assignee: Fuji Photo Film Co., Ltd., Kanagawa, Japan

[21] Appl. No.: 634,740

[22] Filed: Apr. 18, 1996

[30] Foreign Application Priority Data

Apr. 18, 1995 [JP] Japan ..... 7-115236

[51] Int. Cl.[6] ..... G03C 1/498

[52] U.S. Cl. ..... 430/619; 430/203; 430/600; 430/611; 430/613; 430/617

[58] Field of Search ..... 430/613, 600, 430/203, 611, 617, 619

[56] References Cited

U.S. PATENT DOCUMENTS 3,152,904 10/1964 Sorensen et al. .
3,457,075 7/1969 Morgan et al. .
5,116,716 5/1992 Komamura et al. ..... 430/203

OTHER PUBLICATIONS

Donald H. Klosterboer, *Thermally Processed Silver Systems, In Imaging Processes and Materials* pp. 279–290 (John Sturge et al. eds.).

*Primary Examiner*—Thorl Chea
*Attorney, Agent, or Firm*—Birch, Stewart, Kolasch & Birch, LLP

[57] ABSTRACT

The present invention provides a heat-developable photographic light-sensitive material which can give a high contrast image. A novel heat-developable photographic light-sensitive material is provided, comprising at least one compound represented by formula (I):

(I)

wherein Z represents a non-metallic atom group necessary for the formation of a nitrogen-containing heterocyclic group.

20 Claims, No Drawings

HEAT-DEVELOPABLE PHOTOGRAPHIC LIGHT-SENSITIVE MATERIAL

FIELD OF THE INVENTION

The present invention relates to a heat-developable photographic light-sensitive material and more particularly to a technique for providing a higher contrast.

BACKGROUND OF THE INVENTION

Heat-developable photographic light-sensitive materials which undergo heat development process to form a photographic image are disclosed in U.S. Pat. Nos. 3,152,904 and 3,457,075, and D. Morgan and B. Shely, "Thermally Processed Silver Systems", Imaging Processes and Materials, Neblette, 8th ed., Sturge, V. Walworth, A. Shepp, page 2, 1969.

Such a heat-developable photographic light-sensitive material normally comprises a reducible silver source (e.g., organic silver salt), a catalytically active amount of a photocatalyst (e.g., silver halide) and a reducing agent, usually dispersed in a (organic) binder matrix. If necessary, a color toning agent for controlling the tone of silver may be further dispersed therein. The heat-developable photographic light-sensitive material stays stable at ordinary temperatures. The heat-developable photographic light-sensitive material which has been exposed to light is heated to a temperature as high as not lower than 80° C. to allow the reducible silver source (which acts as an oxidizer) and the reducing agent to undergo redox reaction to produce silver. This redox reaction is accelerated by the catalytic action of a latent image produced by exposure. The silver produced by the reaction of the organic silver salt in the exposed area provides a black image which forms an image in contrast to the unexposed area.

However, there have been no techniques for controlling development to provide a higher contrast. It has been desired to develop such a technique.

SUMMARY OF THE INVENTION

It is therefore an object of the present invention to provide a heat-developable photographic light-sensitive material which can form a high contrast image.

It is another object of the present invention to provide a heat-developable photographic light-sensitive material which can minimize the generation of fog and form a high contrast image.

These and other objects of the present invention will become more apparent from the following detailed description and examples.

The foregoing objects of the present invention can be accomplished with the following inventions:

(1) A heat-developable photographic light-sensitive material, comprising at least one compound represented by formula (I)

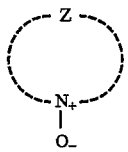

(I)

wherein Z represents a non-metallic atom group necessary for the formation of a nitrogen-containing heterocyclic group.

(2) A heat-developable photographic light-sensitive material, comprising at least one compound represented by the general formula (I) and at least one compound represented by formula (II)

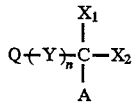

(II)

wherein Q represents an aryl group or a heterocyclic group; $X_1$ and $X_2$ each represents a halogen atom; A represents a hydrogen atom, a halogen atom or an electron-withdrawing group; Y represents —C(=O)— or —$SO_2$—; and n represents an integer of 0 or 1.

(3) The heat-developable photographic light-sensitive material according to Clause 1 or 2, which is adapted for infrared laser exposure.

DETAILED DESCRIPTION OF THE INVENTION

Formula (I) will be further described hereinafter.

The heterocyclic group formed by Z is a saturated or unsaturated 3- to 10-membered heterocyclic group containing at least one nitrogen atom. Such a heterocyclic group may be monocyclic or may form a condensed ring with other rings.

The heterocyclic group is preferably a 5- or 6-membered aromatic heterocyclic group, more preferably a 5- or 6-membered aromatic heterocyclic group containing from 1 to 3 nitrogen atoms.

Specific examples of the heterocyclic group formed by Z include pyrrolidine, piperidine, piperazine, morpholine, pyrrole, imidazole, pyrazole, isothiazole, isoxazole, pyridine, pyrazine, pyrimidine, pyridazine, indolizine, triazole, triazine, indole, isoindole, indazole, purine, quinolizine, isoquinolizine, thiadiazole, oxadiazole, quinoline, phthalazine, naphthyridine, quinoxaline, quinazoline, cinnoline, pteridine, carbazole, phenanthridine, acridine, perimidine, phenanthroline, phenazine, phenothiazine, furazane, phenoxazine, tetrazole, thiazole, oxazole, benzimidazole, benzoxazole, benzthiazole, and indolenine.

Preferred among these heterocyclic groups are pyrrole, imidazole, pyrazole, isothiazole, isoxazole, pyridine, pyrazine, pyrimidine, pyridazine, indolizine, triazole, triazine, indole, isoindole, indazole, purine, quinolizine, isoquinolizine, thiadiazole, oxadiazole, quinoline, phthalazine, naphthyridine, quinoxaline, quinazoline, cinnoline, pteridine, carbazole, phenanthridine, furazane, phenoxazine, tetrazole, thiazole, oxazole, benzimidazole, benzoxazole, benzthiazole, and indolenine.

More preferred among these heterocyclic groups are isothiazole, isoxazole, pyridine, pyrazine, pyrimidine, pyridazine, indolizine, triazole, triazine, quinolizine, isoquinolizine, thiadiazole, oxadiazole, quinoline, phthalazine, naphthyridine, quinoxaline, quinazoline, cinnoline, pteridine, phenanthridine, acridine, phenanthroline, phenazine, furazane, thiazole, oxazole, benzoxazole, benzthiazole, and indolenine.

Still more preferred among these heterocyclic groups are pyridine, pyrazine, pyrimidine, pyridazine, triazine, isoquinolizine, thiadiazole, oxadiazole, quinoline, phthalazine, naphthyridine, quinoxaline, quinazoline, cinnoline, pteridine, phenanthridine, acridine, phenanthroline, phenazine, furazane, thiazole, oxazole, benzoxazole, benzthiazole, and indolenine.

Particularly preferred among these heterocyclic groups are pyridine, pyrazine, pyrimidine, pyridazine, triazine, quinolizine, phthalazine, naphthyridine, quinoxaline, quinazoline, cinnoline, pteridine, phenanthridine, acridine, phenanthroline, and phenazine.

Most preferred among these heterocyclic groups is pyridine.

The heterocyclic group formed by Z may have substituents. Examples of such substituents include alkyl group (preferably $C_{1-20}$, more preferably $C_{1-12}$, particularly $C_{1-8}$ alkyl group, e.g., methyl, ethyl, iso-propyl, tert-butyl, n-octyl, n-decyl, n-hexadecyl, cyclopropyl, cyclopentyl, cyclohexyl), alkenyl group (preferably $C_{2-20}$, more preferably $C_{2-12}$, particularly $C_{2-8}$ alkenyl group, e.g., vinyl, allyl, 2-butenyl, 3-pentenyl), alkinyl group (preferably $C_{2-20}$, more preferably $C_{2-12}$, particularly $C_{2-8}$ alkinyl group, e.g., propargyl, 3-pentinyl), aryl group (preferably $C_{6-30}$, more preferably $C_{6-20}$, particularly $C_{6-12}$ aryl group, e.g., phenyl, p-methylphenyl, naphthyl), amino group (preferably $C_{0-20}$, more preferably $C_{0-10}$, particularly $C_{0-6}$ amino group, e.g., amino, methylamino, dimethylamino, diethylamino, dibenzylamino), alkoxy group (preferably $C_{1-20}$, more preferably $C_{1-12}$, particularly $C_{1-8}$ alkoxy group, e.g., methoxy, ethoxy, butoxy), aryloxy group (preferably $C_{6-20}$, more preferably $C_{6-16}$, particularly $C_{6-12}$ aryloxy group, e.g., phenyloxy, 2-naphthyloxy), acyl group (preferably $C_{1-20}$, more preferably $C_{1-16}$, particularly $C_{1-12}$ acyl group, e.g., acetyl, benzoyl, formyl, pivaloyl), alkoxycarbonyl group (preferably $C_{2-20}$, more preferably $C_{2-16}$, particularly $C_{2-12}$ alkoxycarbonyl group, e.g., methoxycarbonyl, ethoxycarbonyl), aryloxycarbonyl group (preferably $C_{7-20}$, more preferably $C_{7-16}$, particularly $C_{7-10}$ aryloxycarbonyl group, e.g., phenyloxycarbonyl), acyloxy group (preferably $C_{2-20}$, more preferably $C_{2-16}$, particularly $C_{2-10}$ acyloxy group, e.g., acetoxy, benzoyloxy), acylamino group (preferably $C_{2-20}$, more preferably $C_{2-16}$, particularly $C_{2-10}$ acylamino group, e.g., acetylamino, benzoylamino), alkoxycarbonylamino group (preferably $C_{2-20}$, more preferably $C_{2-16}$, particularly $C_{2-12}$ alkoxycarbonylamino group, e.g., methoxycarbonylamino), aryloxycarbonylamino group (preferably $C_{7-20}$, more preferably $C_{7-16}$, particularly $C_{7-12}$ aryloxycarbonylamino group, e.g., phenyloxycarbonylamino), sulfonylamino group (preferably $C_{1-20}$, more preferably $C_{1-16}$, particularly $C_{1-12}$ sulfonylamino group, e.g., methanesulfonylamino, benzenesulfonylamino), sulfamoyl group (preferably $C_{0-20}$, more preferably $C_{0-16}$, particularly $C_{0-12}$ sulfamoyl group, e.g., sulfamoyl, methylsulfamoyl, dimethylsulfamoyl, phenylsulfamoyl), carbamoyl group (preferably $C_{1-20}$, more preferably $C_{1-16}$, particularly $C_{1-12}$ carbamoyl group, e.g., carbamoyl, methylcarbamoyl, diethylcarbamoyl, phenylcarbamoyl), alkylthio group (preferably $C_{1-20}$, more preferably $C_{1-16}$, particularly $C_{1-12}$ alkylthio group, e.g., methylthio, ethylthio), arylthio group (preferably $C_{6-20}$, more preferably $C_{6-16}$, particularly $C_{6-12}$ arylthio group, e.g., phenylthio), sulfonyl group (preferably $C_{1-20}$, more preferably $C_{1-16}$, particularly $C_{1-12}$ sulfonyl group, e.g., mesyl, tosyl), sulfinyl group (preferably $C_{1-20}$, more preferably $C_{1-16}$, particularly $C_{1-12}$ sulfinyl group, e.g., methanesulfinyl, benzenesulfinyl), ureide group (preferably $C_{1-20}$, more preferably $C_{1-16}$, particularly $C_{1-12}$ ureide group, e.g., ureide, methylureide, phenylureide), phosphoric acid amide group (preferably $C_{1-20}$, more preferably $C_{1-16}$, particularly $C_{1-12}$ phosphoric acid amide group, e.g., diethylphosphoric acid amide, phenylphosphoric acid amide), hydroxyl group, mercapto group, halogen atom (e.g., fluorine, chlorine, bromine, iodine), cyano group, sulfo group, carboxyl group, nitro group, hydroxamic acid group, sulfino group, hydrazino group, disulfide group, and heterocyclic group (e.g., imidazolyl, pyridyl, furyl, piperidyl, morpholino). These substituents may be further substituted. If there are two or more substituents, they may be the same or different.

Preferred examples of these substituents include alkyl group, aryl group, alkoxy group, aryloxy group, acyloxy group acylamino group, alkoxycarbonylamino group, aryloxycarbonylamino group, sulfonylamino group, sulfamoyl group, carbamoyl group, alkylthio group, arylthio group, sulfonyl group, sulfinyl group, ureide group, phosphoric acid amide group, hydroxyl group, mercapto group, sulfo group, carboxyl group, nitro group, and heterocyclic group. More preferred examples of these substituents include alkyl group, aryl group, alkoxy group, aryloxy group, acyloxy group, acylamino group, alkoxycarbonylamino group, aryloxycarbonylamino group, sulfonylamino group, sulfamoyl group, carbamoyl group, alkylthio group, arylthio group, sulfonyl group, sulfinyl group, ureide group, phosphoric acid amide group, hydroxyl group, mercapto group, sulfo group, carboxyl group, nitro group, disulfide group, and heterocyclic group. Still more preferred examples of these substituents include alkyl group, aryl group, alkoxy group, aryloxy group, acyloxy group, acylamino group, alkoxycarbonylamino group, aryloxycarbonylamino group, sulfonylamino group, sulfamoyl group, carbamoyl group, alkylthio group, arylthio group, ureide group, hydroxyl group, mercapto group, sulfo group, carboxyl group, nitro group, disulfide group, and heterocyclic group.

A preferred example of the heterocyclic group formed by Z is a heterocyclic group substituted by at least one substituent selected from alkylthio group, arylthio group, mercapto group and disulfide group.

Preferred among compounds represented by formula (I) is one represented by the following general formula (I-a):

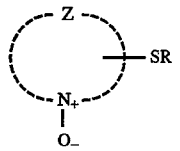

(I-a)

wherein Z is as defined in formula (I), including preferred examples; and R represents a hydrogen atom, an aliphatic hydrocarbon group, an aryl group, a heterocyclic group or SR' in which R' represents an aliphatic hydrocarbon group, an aryl group or a heterocyclic group.

Examples of the aliphatic hydrocarbon group represented by R or R' include straight-chain, branched or cyclic alkyl group (preferably $C_{1-20}$, more preferably $C_{1-16}$, particularly $C_{1-12}$ alkyl group, e.g., methyl, ethyl, n-propyl, iso-propyl, n-butyl, iso-butyl, tert-butyl, n-heptyl, n-hexyl, cyclohexyl), alkenyl group (preferably $C_{2-20}$, more preferably $C_{2-16}$, particularly $C_{2-12}$ alkenyl group, e.g., vinyl, allyl), and alkinyl group (preferably $C_{2-20}$, more preferably $C_{2-16}$, particularly $C_{2-12}$ alkinyl group, e.g., propargyl).

The aliphatic hydrocarbon group represented by R or R' is preferably an alkyl group, more preferably a $C_{1-12}$ alkyl group.

The aryl group represented by R or R' is preferably a $C_{6-30}$ aryl group, more preferably a $C_{6-20}$ monocyclic or condensed aryl group, e.g., phenyl and naphthyl, particularly phenyl.

The heterocyclic group represented by R or R' is a 3- to 10-membered saturated or unsaturated heterocyclic group containing at least one of N, O and S. The heterocyclic group may be monocyclic or may form a condensed ring with other rings.

The heterocyclic group is preferably a 5- or 6-membered aromatic heterocyclic group, more preferably a 5- or 6-membered aromatic heterocyclic group containing at least one nitrogen atom, particularly a 5- or 6-membered aromatic heterocyclic group containing 1 to 3 nitrogen atoms.

Specific examples of the heterocyclic group include pyrrolidine, piperidine, piperazine, morpholine, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, and benthiazole. Preferred among these heterocyclic groups are thiophene, furan, pyrrole, imidazole, pyrazole, pyridine, pyrazine, pyridazine, triazole, triazine, indole, indazole, thiadiazole, oxadiazole, quinoline, phthalazine, naphthyridine, quinoxaline, quinazoline, cinnoline, pteridine, tetrazole, thiazole, oxazole, benzimidazole, benzoxazole, benthiazole, and indolenine. More preferred among these heterocyclic groups are pyrrole, imidazole, pyrazole, pyridine, pyrazine, pyridazine, triazole, triazine, indole, indazole, thiadiazole, oxadiazole, quinoline, phthalazine, naphthyridine, quinoxaline, tetrazole, thiazole, oxazole, benzimidazole, benzoxazole, benthiazole, and indolenine. Most preferred among these heterocyclic groups are pyridine, triazole, triazine, thiadiazole, oxadiazole, quinoline, tetrazole, thiazole, oxazole, benzimidazole, benzoxazole, benthiazole, and indolenine.

The aliphatic hydrocarbon group, aryl group or heterocyclic group represented by R or R' may have substituent(s). Examples of these substituents include those listed with reference to the heterocyclic group formed by Z.

R is preferably —SR'.

More preferred among compounds represented by formula (I) is one represented by the following formula (I-b):

(I-b)

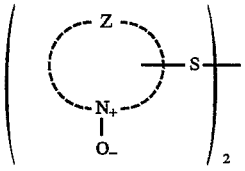

wherein Z is as defined in formula (I), including preferred examples.

More preferred among compounds represented by formula (I) is one represented by the following formula (I-c):

(I-c)

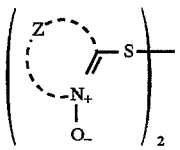

wherein Z is as defined in formula (I), including preferred examples.

Specific examples of the compound represented by formula (I) will be given below, but the present invention should not be construed as being limited thereto.

I-1

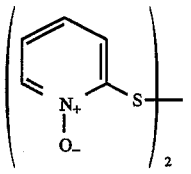

I-2

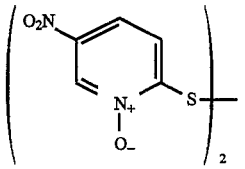

I-3

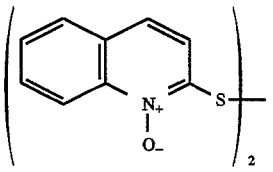

I-4

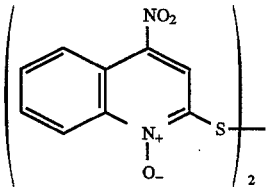

I-5

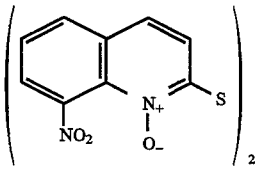

I-6

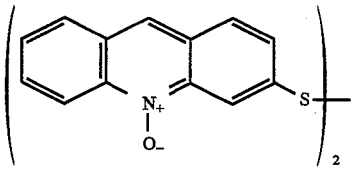

I-7

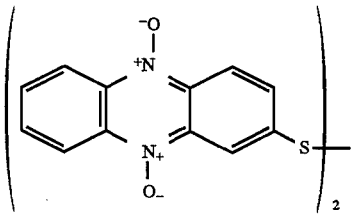

I-8

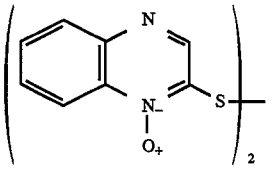

I-9

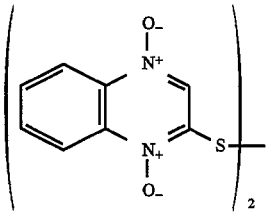

-continued
I-10
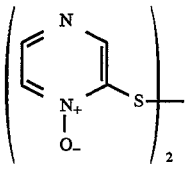
I-11
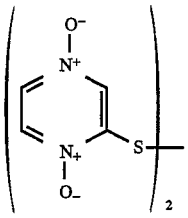
I-12
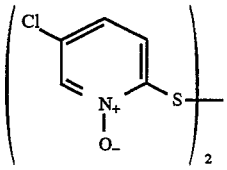
I-13
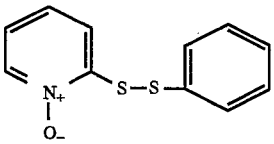
I-14
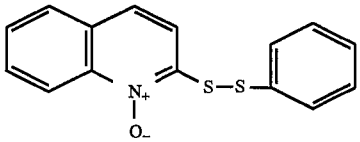
I-15
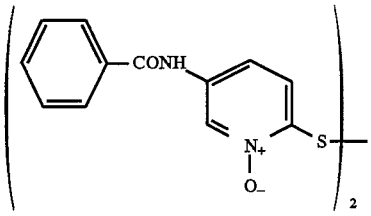
I-16
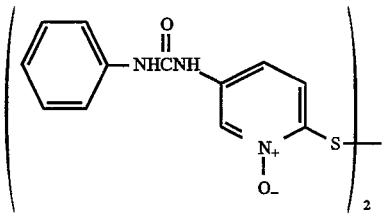
I-17
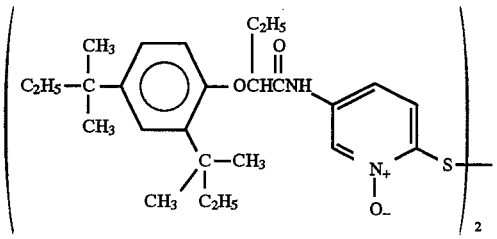
-continued
I-18
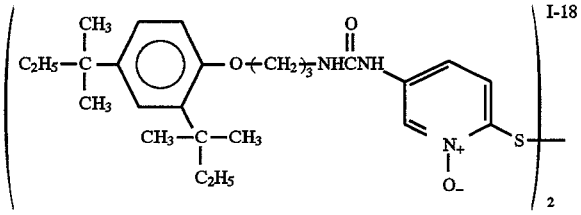
I-19
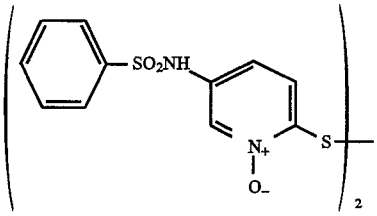
I-20
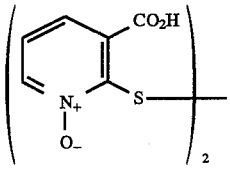
I-21
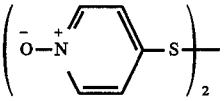
I-22
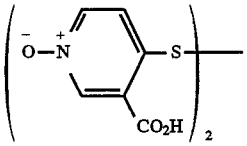
I-23
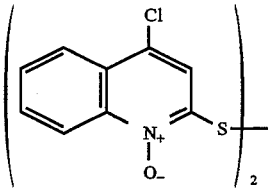
I-24
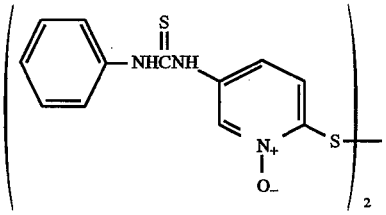
I-25
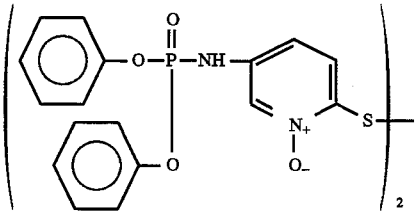

-continued
I-26
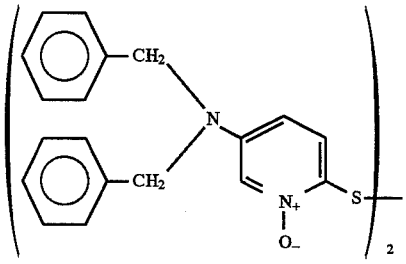
I-27
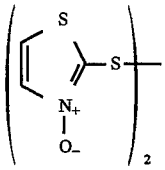
I-28
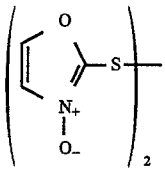
I-29
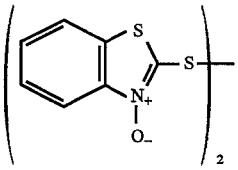
I-30
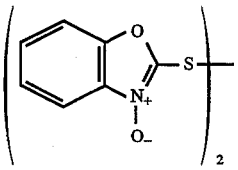
I-31
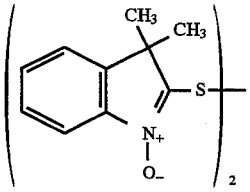
I-32
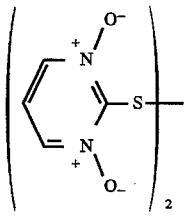
I-33
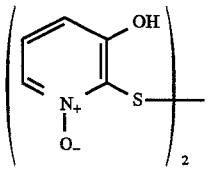
-continued
I-34
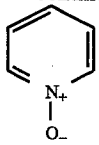
I-35
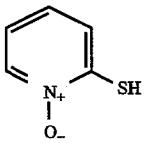
I-36
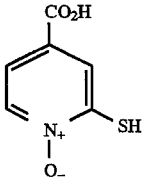
I-37
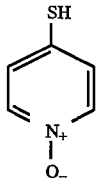
I-38
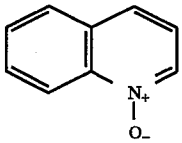
I-39
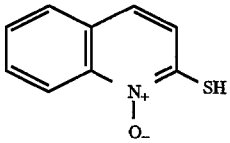
I-40
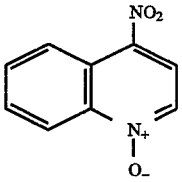
I-41
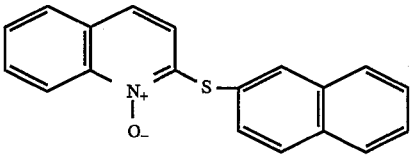
I-42
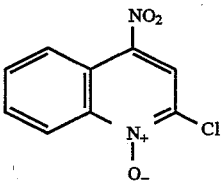
I-43
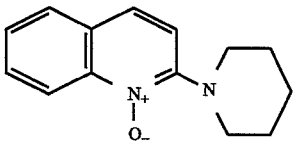

-continued

I-44

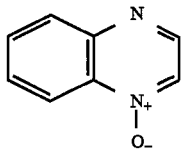

I-45

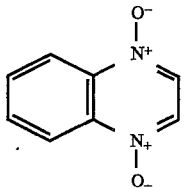

I-46

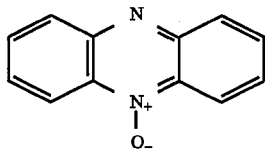

I-47

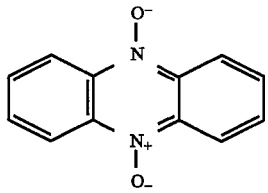

I-48

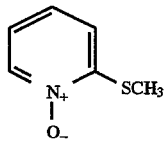

The foregoing compounds may be optionally used in the form of salt.

The synthesis of the compound of the present invention represented by formula (I) can be accomplished by ordinary N-oxide compound synthesis methods as described in "Shinjikken Kagaku Koza (New Institute of Experimental Chemistry)", vol. 15, pp. 660–662, Maruzen.

The compound represented by formula (II) will be further described hereinafter.

The aryl group represented by Q is preferably a $C_{6-30}$, more preferably $C_{6-20}$ monocyclic or condensed-ring aryl group, e.g., phenyl and naphthyl, particularly phenyl.

The heterocyclic group represented by Q is a $C_{1-30}$ 3- to 10-membered saturated or unsaturated heterocyclic group containing at least one of N, O and S atoms. The heterocyclic group may be monocyclic or may form a condensed ring with other rings.

The heterocyclic group is preferably a 5- or 6-membered aromatic heterocyclic group, more preferably a 5- or 6-membered aromatic heterocyclic group containing at least one nitrogen atom, particularly a 5- or 6-membered aromatic heterocyclic group containing 1 to 3 nitrogen atoms.

Specific examples of the heterocyclic group include pyrrolidine, piperidine, piperazine, morpholine, thiophene, furan, pyrrole, imidazole, pyrazole, pyridine; pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, and benthiazole. Preferred among these heterocyclic groups are thiophene, furan, pyrrole, imidazole, pyrazole, pyridine, pyrazine, pyridazine, triazole, triazine, indole, indazole, thiadiazole, oxadiazole, quinoline, phthalazine, naphthyridine, quinoxaline, quinazoline, cinnoline, pteridine, tetrazole, thiazole, oxazole, benzimidazole, benzoxazole, benthiazole, and indolenine. More preferred among these heterocyclic groups are pyrrole, imidazole, pyrazole, pyridine, pyrazine, pyridazine, triazole, triazine, indole, indazole, thiadiazole, oxadiazole, quinoline, phthalazine, naphthyridine, quinoxaline, tetrazole, thiazole, oxazole, benzimidazole, benzoxazole, benthiazole, and indolenine. Most preferred among these heterocyclic groups are pyridine, triazole, triazine, thiadiazole, oxadiazole, quinoline, tetrazole, thiazole, oxazole, benzimidazole, benzoxazole, benthiazole, and indolenine.

Q is preferably an aromatic nitrogen-containing heterocyclic group.

The halogen atoms represented by $X_1$ and $X_2$ may be the same or different and each represents a fluorine atom, chlorine atom, bromine atom or iodine atom, preferably chlorine atom, chlorine atom or iodine atom, more preferably chlorine atom or bromine atom, particularly bromine atom.

The halogen atom represented by A is a fluorine atom, chlorine atom, bromine atom or iodine atom, preferably chlorine atom, bromine atom or iodine atom, more preferably chlorine atom or bromine atom, particularly bromine atom.

The electron-withdrawing group represented by A is preferably a substituent having $\sigma_p$ value of from not less than 0.01 to not more than 1.0, more preferably from not less than 0.1 to not more than 1.0. Examples of such an electron-withdrawing group include trihalomethyl group ($CBr_3$ (0.29), $CCl_3$(0.33), $CF_3$(0.54)), cyano group (0.66), nitro group (0.78), $C_{1-10}$ sulfonyl group (methanesulfonyl (0.72)), $C_{2-10}$ acyl group (acetyl (0.50)), $C_{2-10}$ alkinyl group ($C{\equiv}CH$(0.23)), $C_{2-10}$ alkoxycarbonyl group (methoxycarbonyl(0.45)), $C_{6-12}$ aryloxycarbonyl group (phenoxycarbonyl (0.44)), $C_{1-10}$ carbamoyl group (carbamoyl(0.36)), and $C_{0-10}$ sulfamoyl group (sulfamoyl (0.57)). Preferred among these electron-withdrawing groups are sulfonyl group, acyl group, alkoxycarbonyl group, and aryloxycarbonyl group.

A is preferably a halogen atom, preferably chlorine atom, bromine atom or iodine atom, more preferably chlorine atom or bromine atom, most preferably bromine atom.

Y represents —C(=O)— or —$SO_2$—, preferably —$SO_2$—.

The suffix n represents an integer of 0 or 1, preferably 1 if Y is —$SO_2$—.

Preferred among compounds represented by formula (II) is one represented by the following formula (II-a):

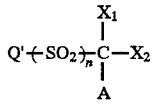

(II-a)

wherein $X_1$, $X_2$, A and n are as defined in formula (II), including preferred examples; and Q' represents an aromatic nitrogen-containing heterocyclic group.

The aromatic nitrogen-containing heterocyclic group represented by Q' is preferably a 5- or 6-membered aromatic heterocyclic group containing from 1 to 3 nitrogen atoms. Examples of such an aromatic heterocyclic group include pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benthiazole, and indolenine. Preferred among these heterocyclic groups are pyridine, triazole, triazine, thiadiazole, oxadiazole, quinoline, tetrazole, thiazole, oxazole, benzimidazole, benzoxazole, benthiazole, and indolenine.

Preferred among compounds represented by formula (II) is one represented by the following formula (II-b):

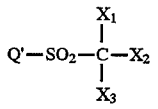

(II-b)

wherein $X_1$ and $X_2$ are as defined in formula (II), including preferred examples; Q' is as defined in formula (II-a), including preferred examples; and $X_3$ represents a halogen atom.

The halogen atom represented by $X_3$ is preferably a chlorine atom, bromine atom or iodine atom, more preferably chlorine atom or bromine atom, particularly bromine atom.

Specific examples of the compound represented by formula (II) will be given below, but the present invention should not be construed as being limited thereto.

II-1

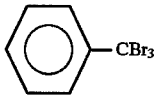

II-2

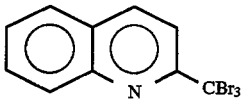

II-3

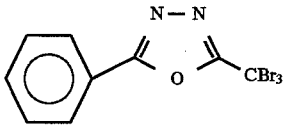

II-4

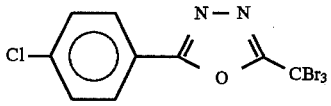

II-5

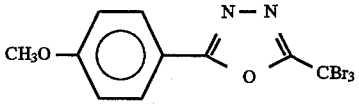

II-6

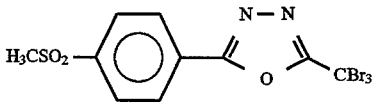

II-7

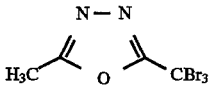

II-8

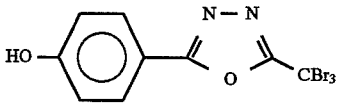

II-9

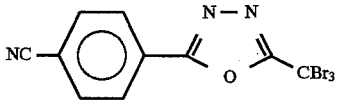

-continued

II-10

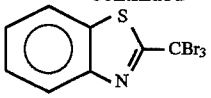

II-11

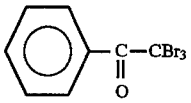

II-12

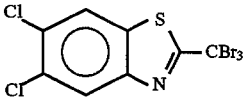

II-13

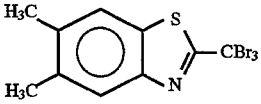

II-14

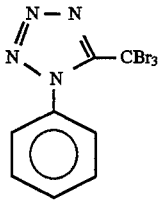

II-15

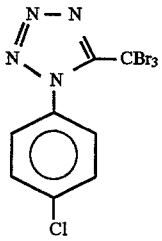

II-16

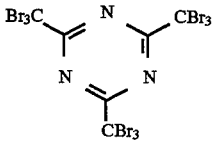

II-17

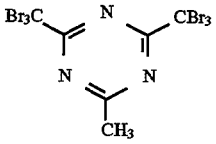

II-18

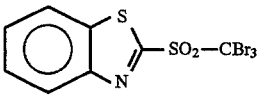

II-19

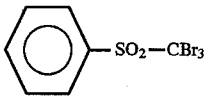

II-20

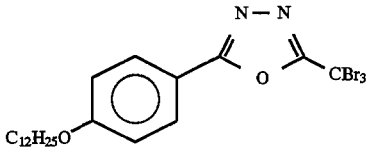

II-21

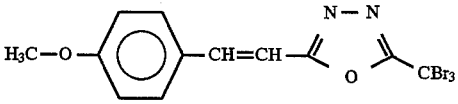

-continued

II-22

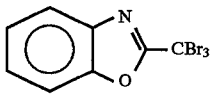

II-23

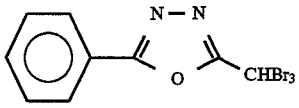

II-24

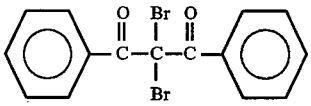

II-25

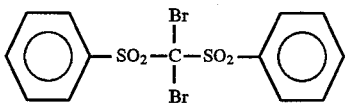

II-26

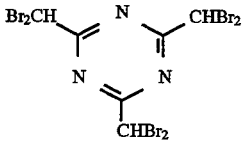

II-27

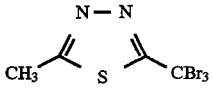

II-28

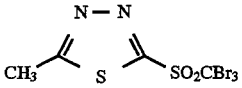

II-29

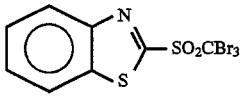

II-30

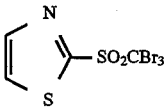

II-31

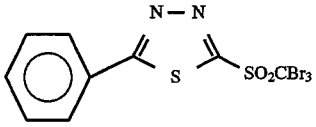

II-32

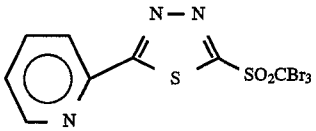

II-33

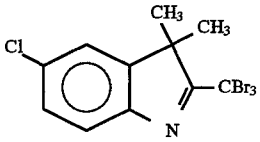

II-34

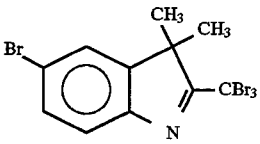

-continued

II-35

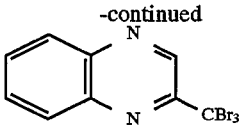

II-36

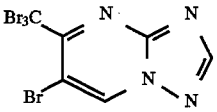

II-37

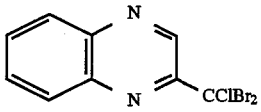

II-38

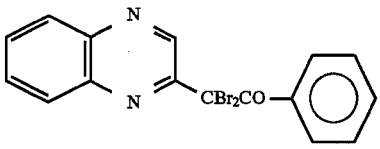

II-39

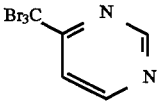

II-40

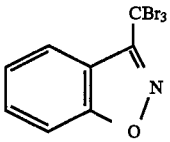

II-41

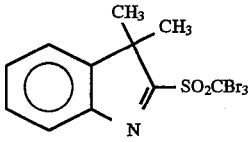

II-42

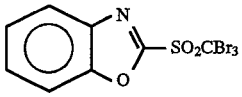

II-43

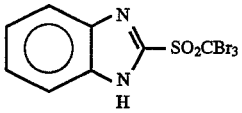

These compounds may be optionally used in the form of salt.

The synthesis of the compound of the present invention represented by formula (II) can be accomplished by any method as described in U.S. Pat. No. 3,874,946 and EP 605,981.

The compound represented by formula (I) or (II) may be incorporated in either the light-sensitive layer or the light-insensitive layer, preferably light-sensitive layer.

The compound represented by formula (I) or (II) may be incorporated in an amount of from $10^{-4}$ mol to 1 mol/mol of Ag, preferably from $10^{-3}$ mol to 0.4 mol/mol of Ag, more preferably from $10^{-3}$ mol to $3\times10^{-2}$ mol/mol of Ag, though depending on the desired purpose.

Any of these compounds may be preferably incorporated in a layer in the form of solution in an organic solvent.

The heat-developable photographic light-sensitive material of the present invention is preferably of a monosheet type (all the materials provided for the formation of an image are incorporated in the image sheet to be viewed) from the standpoint of environmental protection.

The heat-developable photographic light-sensitive material of the present invention is also preferably adapted for infrared laser exposure. It is further preferred that the wavelength of the infrared laser to which the heat-developable photographic light-sensitive material of the present invention is exposed be from 750 nm to 1,200 nm, more preferably from 800 nm to 1,000 nm. Sensitizing in such an infrared laser wavelength range is attained by chemically sensitizing the heat-developable photographic light-sensitive material with a spectrally sensitizing dye having a $\lambda_{max}$ value in such an infrared laser wavelength range.

The heat-developable photographic light-sensitive material of the present invention undergoes heat development process to form a photographic image. Such a heat-developable photographic light-sensitive material is disclosed in U.S. Pat. Nos. 3,152,904 and 3,457,075, and D. Morgan and B. Shely, "Thermally Processed Silver Systems", Imaging Processes and Materials, Neblette, 8th ed., Sturge, V. Walworth, A. Shepp, page 2, 1969.

The heat-developable photographic light-sensitive material of the present invention may be in any form so far as it undergoes heat development process to form a photographic image. The heat-developable photographic light-sensitive material of the present invention preferably comprises a reducible silver source (e.g., organic silver salt), a catalytically active amount of a photocatalyst (e.g., silver halide) and a reducing agent, usually dispersed in a (organic) binder matrix. If necessary, a color toning agent for controlling the tone of silver may be further dispersed therein. The heat-developable photographic light-sensitive material stays stable at ordinary temperatures. The heat-developable photographic light-sensitive material which has been exposed to light is heated to a high temperature (e.g., 80° C. to 200° C. for 0.5 sec. to 300 sec.) to allow the reducible silver source (which acts as an oxidizer) and the reducing agent to undergo redox reaction to produce silver. This redox reaction is accelerated by the catalytic action of a latent image produced by exposure. The silver produced by the reaction of the organic silver salt in the exposed area provides a black image which forms an image in contrast to the unexposed area.

The heat-developable photographic light-sensitive material of the present invention comprises at least one light-sensitive layer on a support. It may comprise only a light-sensitive layer formed on a support but preferably comprises at least one light-insensitive layer on the light-sensitive layer.

In order to control the amount of light transmitted by the light-sensitive layer or the wavelength distribution of the transmitted light, a filter layer may be formed on the same side of the support as the light-sensitive layer or on the side of the support opposite the light-sensitive layer. Alternatively, a dye or pigment may be incorporated in the light-sensitive layer.

The light-sensitive layer may be in a multi-layer form. Further, in order to control the gradation, the light-sensitive layer may have a high sensitivity layer/low sensitivity layer structure or low sensitivity layer/high sensitivity layer structure.

Various additives may be incorporated in the light-sensitive layer, light-insensitive layer or other constituent layers.

Examples of the support which can apply to the heat-developable photographic light-sensitive material of the present invention include materials such as paper, polyethylene-coated paper, polypropylene-coated paper, parchment, or cloth: sheets or thin films of metal such as aluminum, copper, magnesium and zinc; glass, glass coated with a metal such as chromium alloy, steel, silver, gold and platinum; and synthetic polymer materials such as poly (alkylmethacrylate) (e.g., poly(methylmethacrylate), polyester (e.g., poly(ethyleneterephthalate)), poly(vinylacetal), polyamide (e.g., nylon) and cellulose ester (e.g., cellulose nitrate, cellulose acetate, cellulose acetate propionate, cellulose acetate butyrate).

The heat-developable photographic light-sensitive material of the present invention may comprise a surface active agent, oxidation inhibitor, stabilizer, plasticizer, ultraviolet absorbent, coating aid, etc. incorporated therein.

The binder layers (e.g., synthetic polymer) each may form a self-supporting film with chemicals contained in the heat-developable photographic light-sensitive material of the present invention.

The support may be coated with a known reinforcing material such as vinylidene chloride, acrylic monomer (e.g., acrylonitrile, methyl acrylate), copolymer or terpolymer of unsaturated dicarboxylic acid (e.g., itaconic acid, acrylic acid), carboxymethyl cellulose, copolymer or terpolymer of poly(acrylamide) and analogous polymer so that it is reinforced.

The suitable binder is transparent or semitransparent. It is normally colorless. Examples of such a binder include natural polymer, synthetic resin, polymer, copolymer, and film-forming medium such as gelatin, gum arabic, poly (vinylalcohol), hydroxyethyl cellulose, cellulose acetate, cellulose acetate butyrate, poly(vinylpyrrolidone), casein, starch, poly(acrylic acid), poly(methylmethacridone), poly (vinyl chloride), poly(methacrylic acid), copoly(styrene-maleic anhydride), copoly(styrene-acrylonitrile), copoly (styrene-butadiene), poly(vinylacetal) (e.g., poly (vinylformal), poly(vinylbutyral), poly(ester), poly (urethane), phenoxy resin, poly(vinylidene chloride), poly (epoxide), poly(carbonate), poly(vinyl acetate), cellulose ester and poly(amide). The binder may be applied in the form of solution in water or organic solvent or in the form of emulsion.

The incorporation of a color toning agent is very desirable. Preferred examples of color toning agent are disclosed in Research Disclosure No. 17029. Specific examples of such color toning agents include imides (e.g., phthalimide); cyclic imides, pyrazoline-5-ones, and quinazolinone (e.g., succinimide, 3-phenyl-2-pyrazoline-5-one, 1-phenylurazole, quinazoline, 2,4-thiazolidinedione); naphthalimides (e.g., N-hydroxy-1,8-naphthalimide); cobalt complexes (e.g., cobalt hexaminetrifluoroacetate), mercaptanes (e.g., 3-mercapto-1,2,4-triazole); N-(aminomethyl) aryldicarboxyimides (e.g., N-(dimethylaminomethyl) phthalimide); blocked pyrazoles, isothiuronium derivatives, and combination of certain kinds of light bleaching agents (e.g., N,N'-hexamethylene(1-carbamoyl-3,5-dimethylpyrazole), 1,8-(3,6-dioxaoctane)bis (isothiuroniumtrifluoroacetate), 2-(tribromomethylsulfonyl) benzothiazole); melocyanine dyes (e.g., 3-ethyl-5-((3-ethyl-2-benzothiazolinylidene)-1-methylethylidene)-2-thio-2,4-oxazolidinedione)); phthalazinone (phthalazone), phthalazinone derivatives and metallic salts thereof (e.g., 4-(1-naphtyl)phthalazinone, 6-chlorophthalazinone, 5,7-dimethyloxyphthalazinone, 2,3-dihydro-1,4-phthalazinone); combination of phthalazinone and sulfinic acid derivative (e.g., 6-chlorophthazinone+sodium benzenesulfinic acid, 8-methylphthalazinone+sodium p-toluenesulfonate); phthalazine; combination of phthalazine and phthalic acid; combination of phthalazine (including adduct of phthalazine) and at least one compound selected from the group consisting of maleic anhydride, phthalic acid, 2,3-naphthalenedicarboxylic acid, o-phenylenic acid derivative and anhydrides thereof (e.g., phthalic anhydride, 4-methylphthalic anhydride, 4-nitrophthalic anhydride, tetrachlorophthalic anhydride); quinazolinediones, benzoxazines, naphthoxazine derivatives; benzoxazine-2,4-diones (e.g., 1,3-benzoxazine-2,4-dione); and pyrimidines and asymmetric triazines (e.g., 2,4-dihydroxypyrimidine), and tetraazapentalene derivatives (e.g., 3,6-dimercapto-1,4-diphenyl-1H, 4H-2,3a,5,6a-tetraazapentalene).

Preferred among these color toning agents are phthalazine and phthalazone represented by the following formula:

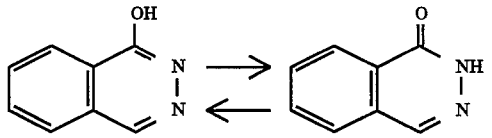

As the reducing agent there may be used a so-called photographic developer such as phenidone, hydroquinone and catechol, preferably hindered phenol. A color photographic light-sensitive material as disclosed in U.S. Pat. No. 4,460,681 is possible in the implementation of the present invention.

Preferred examples of the reducing agent are disclosed in U.S. Pat. Nos. 3,770,448, 3,773,512 and 3,593,863, and Research Disclosure Nos. 17,029 and 29,963. Specific examples of these reducing agents include aminohydroxycycloalkenone compounds (e.g., 2-hydroxy-piperidino-2-cyclohexenone); amino reductones and esters (e.g., piperidinohexose reductone monoacetate); N-hydroxyurea derivatives (e.g., N-p-methylphenyl-N-hydroxyurea); aldehyde or ketone hydrazones (e.g., anthracene aldehyde phenyl hydrazone), phosphor amide phenols; phosphor amide anilines; polyhydroxybenzenes (e.g., hydroquinone, t-butylhydroquinone, isopropylhydroquinone, (2,5-dihydroxyphenyl) methylsulfone); sulfohydroxamic acids (e.g., benzenesulfohydroxamic acid); sulfoneamideanilines (e.g., 4-(N-methanesulfoneamide)aniline); 2-tetrazolylthio) hydroquinone); tetrahydroquinoxalines (e.g., 1,2,3,4-tetrahydroquinoxaline); amideoxins; azines (e.g., combination of aliphatic carboxylic arylhydrazide and ascorbic acid); combination of polyhydroxybenzene and hydroxylamine, reductone and/or hydrazine; hydroxamic acids; combination of azines and sulfonamidephenols; α-cyanophenylacetic acid derivatives; combination of bis-β-naphthol and 1,3-dihydroxybenzene derivatives; 5-pyrazolones; sulfonamidephenol reducing agents; 2-phenylidane-1,3-diones; chroman; 1,4-dihydropyridines (e.g., 2,6-dimethoxy-3,5-dicarboethoxy-1,4-dihydropyridine); bisphenols (e.g., bis(2-hydroxy-3-t-butyl-5-methylphenyl)methane, bis(6-hydroxy-m-tri)mesitol, 2,2-bis(4-hydroxy-3-methylphenyl) propane, 4,4-ethylidene-bis(2-t-butyl-6-methyl)phenol)); ultraviolet-responsive ascorbic acid derivatives; and 3-pyrazolidones.

A preferred developer is a hindered phenol represented by the following formula (A):

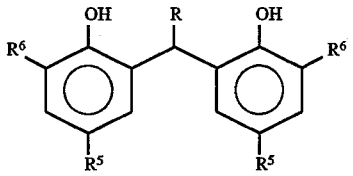

(A)

wherein R represents a hydrogen atom or a $C_{1-10}$ alkyl group (e.g., —$C_4H_9$, 2,4,4-trimethylpentyl); and $R^5$ and $R^6$ each represents a $C_{1-5}$ alkyl group (e.g., methyl, ethyl, t-butyl).

The silver halide to be used as a photocatalyst in the catalytically active amount may be any photosensitive silver halide (e.g., silver bromide, silver iodide, silver chloride, silver bromochloride, silver bromoiodide, silver bromochloroiodide), preferably containing iodine ion. Any method may be employed to incorporate the silver halide in the image-forming layer. In this process, the silver halide is disposed adjacent to the reducible silver source. In general, the silver halide is preferably incorporated in an amount of from 0.75 to 30% by weight based on the weight of the reducible silver source. The silver halide may be prepared by the conversion of a silver soap portion by the reaction with halogen ion. Alternatively, a silver halide which has been previously prepared may be added during the generation of a soap. Further, the two methods may be used in combination. The latter method is preferred.

The reducible silver source may be any material containing a reducible silver ion source. Salts of an organic or heteroorganic acids, particularly long-chain ($C_{10-30}$, preferably $C_{15-25}$) aliphatic carboxylic acids, are preferred. Organic or inorganic silver salt complexes having a total ligand stability constant of from 4.0 to 10.0 with respect to silver ion are useful, too. Preferred examples of silver salts are described in Research Disclosure Nos. 17029 and 29963. Specific examples of these silver salts include salts of organic acids (e.g., gallic acid, oxalic acid, behenic acid, stearic acid, palmitic acid, lauric acid); silver salts of carboxyalkylthiourea (e.g., 1-(3-carboxypropyl)thiourea, 1-(3-carboxypropyl)-3,3-dimethylthiourea); silver complexes of polymerization product of aldehyde (e.g., formaldehyde, acetaldehyde, butylaldehyde) with hydroxyl-substituted aromatic carboxylic acid, hydroxyl-substituted acids (e.g., salicylic acid, benzoic acid, 3,5-dihydroxybenzoic acid, 5,5-thiodisalicylic acid), silver salts or complexes of thioenes (e.g., 3-(2-carboxyethyl)-4-hydroxymethyl-4-thiazoline-2-thioene, 3-carboxymethyl-4-thiazoline-2-thioene), silver complexes or salts of nitrogenic acid selected from the group consisting of imidazole, pyrazole, urazole, 1,2,4-thiazole, 1H-tetrazole, 3-amino-5-benzylthio-1,2,4-triazole and benzotriazole; silver salts of saccharin and 5-chlorosalicylaldoxim; and silver salts of mercaptides. Preferred among these silver sources are stearic acid and behenic acid, particularly behenic acid. The reducible silver source is preferably used in an amount of not more than 3 g/m$^2$, more preferably not more than 2 g/m$^2$, furthermore preferably from 0.1 g/m$^2$ to 2 g/m$^2$, as calculated in terms of silver.

The heat-developable photographic light-sensitive material of the present invention may comprise a sensitizing dye as disclosed in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175, and 4,835,096.

The present invention will be further described in the following examples, but the present invention should not be construed as being limited thereto.

EXAMPLE 1

Preparation of photosensitive emulsion A

| Solution 1 | |
|---|---|
| Stearic acid | 131 g |
| Behenic acid | 635 g |
| Distilled water | 13 l |

The foregoing components were mixed at a temperature of 85° C. for 15 minutes.

| Solution 2 | |
|---|---|
| NaOH | 89 g |
| Distilled water | 1,500 ml |
| Solution 3 | |
| Concentrated $HNO_3$ | 19 ml |
| Distilled water | 50 ml |
| Solution 4 | |
| $AgNO_3$ | 365 g |
| Distilled water | 2,500 ml |
| Solution 5 | |
| Polyvinyl butyral | 88 g |
| Ethyl acetate | 4,300 ml |
| Solution 6 | |
| Polyvinyl butyral | 290 g |
| Isopropanol | 3,580 ml |
| Solution 7 | |
| N-bromosuccinimide | 9.7 g |
| Acetone | 690 ml |

Solution 2 was added to Solution 1 with vigorous stirring while the latter was being kept to a temperature of 85° C. in 5 minutes. Thereafter, Solution 3 was added to the mixture in 25 minutes. The mixture was then stirred at the same temperature for 20 minutes. The mixture was then cooled to a temperature of 35° C. Solution 4 was then added to the mixture at a temperature of 35° C. while the mixture was being stirred more vigorously in 5 minutes. The mixture was then stirred at the same temperature for 90 minutes. Thereafter, Solution 5 was added to the mixture. The agitation was then suspended to allow the mixture to stand. The aqueous solution containing salts was removed to obtain an oil phase which was then desolvented to remove trace amounts of water. To the oil phase was then added Solution 6. The mixture was then vigorously stirred at a temperature of 50° C. Solution 7 was then added to the mixture in 20 minutes. The mixture was then stirred for 105 minutes to obtain Emulsion A.

Various layers were sequentially formed on a 175-μm thick biaxially-oriented polyethylene terepthalate support (free of undercoating layer) colored blue with Dye-A. These layers thus formed were each dried at a temperature of 75° C. for 5 minutes.

| Coating on the back layer side of the support | |
|---|---|
| Anti-halation layer (wet thickness: 80 μm) | |
| Polyvinyl butyral (10% isopropanol solution) | 150 ml |
| Dye-C (solvent: DMF) | 70 mg |
| **Coating on the photosensitive layer side of the support** | |
| Photosensitive layer (wet thickness: 140 μm) | |
| Photosensitive emulsion A | 73 g |
| Sensitizing dye-1 (0.1% DMF solution) | 2 ml |
| Fog inhibitor-1 (0.01% methanol solution) | 3 ml |
| Phthalazone (4.5% DMF solution) | 8 ml |
| Reducing agent-1 (10% acetone solution) | 13 ml |
| Compound | as set forth in |

TABLE 1

| Surface protective layer (wet thickness: 100 μm) | |
|---|---|
| Acetone | 175 ml |
| 2-Propanol | 40 ml |
| Methanol | 15 ml |
| Cellulose acetate | 8.0 g |
| Phthalazine | 1.0 g |
| 4-Methylphthalic acid | 0.72 g |
| Tetrachlorophthalic acid | 0.22 g |
| Tetrachlorophthalic anhydride | 0.5 g |

Dye-C

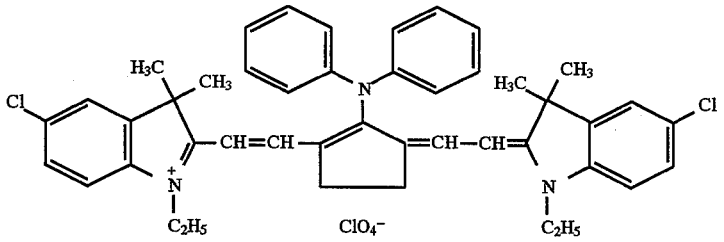

TABLE 1-continued

Sensitizing dye-1

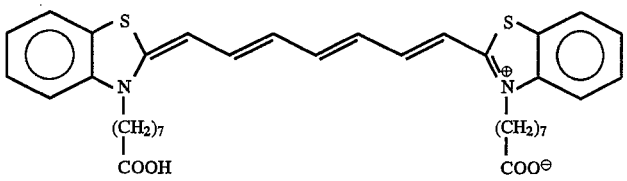

Fog inhibitor-1

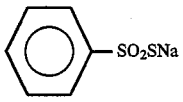

Reducing agent-1

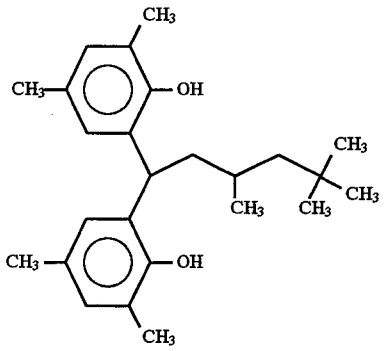

Dye-A

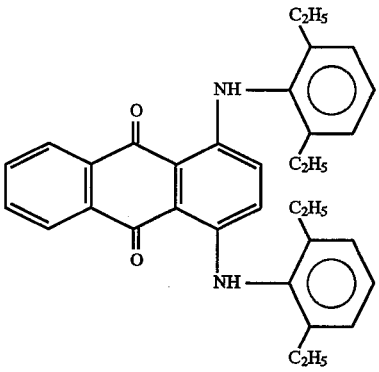

Sensitometry

The heat-developable photographic light-sensitive material thus formed was then worked into a half-size. The heat-developable photographic light-sensitive material was then exposed to 830 nm laser beam inclined 13° out of the perpendicular. The heat-developable photographic light-sensitive material thus exposed was then subjected to heat development at a temperature of 125° C. for 10 seconds.

For the evaluation of gradation, the gamma value between (fog+D)=0.5 and (fog+D)=1.5 was read from logE-D curve of the heat-developable photographic light-sensitive material thus developed.

Ageing test (Δfog)

The heat-developable photographic light-sensitive material was aged at a relative humidity of 50% and a temperature of 50° C. for 3 days, heat-developed at a temperature of 125° C. for 10 seconds, and then examined for generation of fog. The difference in fog value from the unaged heat-developable photographic light-sensitive material was determined to evaluate Δfog.

TABLE 1

| Sample No. | Compound: Formula (I) (Added amount mol/mol · Ag) | Compound: Formula (II) (Added amount mol/mol · Ag) | Gradation | Δfog |
|---|---|---|---|---|
| 1 | — | — | 2.3 | 0.20 |
| 2 | Compound I-1 (0.003) | — | 2.7 | 0.19 |
| 3 | Compound I-1 (0.01) | — | 2.8 | 0.17 |
| 4 | Compound I-1 (0.04) | — | 2.9 | 0.17 |
| 5 | — | Compound II-18 (0.02) | 1.2 | 0.01 |
| 6 | Compound I-1 (0.003) | Compound II-18 (0.02) | 2.7 | 0.01 |
| 7 | Compound I-1 (0.01) | Compound II-18 (0.02) | 2.7 | 0.01 |
| 8 | Compound I-1 (0.04) | Compound II-18 (0.02) | 2.4 | 0.01 |
| 9 | — | Compound II-18 (0.02) | 1.0 | 0.01 |
| 10 | Compound I-1 | Compound II-18 | 2.7 | 0.01 |

TABLE 1-continued

| Sample No. | Compound: Formula (I) (Added amount mol/mol · Ag) | Compound: Formula (II) (Added amount mol/mol · Ag) | Gradation | Δfog |
|---|---|---|---|---|
| | (0.003) | (0.02) | | |
| 11 | Compound I-1 (0.01) | Compound II-18 (0.02) | 2.7 | 0.01 |
| 12 | Compound I-1 (0.04) | Compound II-18 (0.02) | 2.3 | 0.01 |
| 13 | Compound I-41 (0.01) | Compound II-18 (0.02) | 2.3 | 0.01 |
| 14 | Compound I-47 (0.01) | Compound II-18 (0.02) | 2.3 | 0.01 |

Table 1 shows that the samples according to the present invention exhibit a high gradation. Further, the heat-developable photographic light-sensitive material of the present invention can minimize the generation of fog and provide a high contrast when combined with the compound of formula (II).

EXAMPLE 2

Preparation of photosensitive emulsion B

| Solution 1 | |
|---|---|
| Stearic acid | 131 g |
| Behenic acid | 635 g |
| Distilled water | 13 l |

The foregoing components were mixed at a temperature of 85° C. for 15 minutes.

| Solution A | |
|---|---|
| Previously prepared cubic AgBrI (I content: 4 mol %, grain size: 0.06 μm) | 0.22 mol in Ag equivalence |
| Distilled water | 1,250 ml |
| **Solution 2** | |
| NaOH | 89 g |
| Distilled water | 1,500 ml |
| **Solution 3** | |
| Concentrated $HNO_3$ | 19 ml |
| Distilled water | 50 ml |
| **Solution 4** | |
| $AgNO_3$ | 365 g |
| Distilled water | 2,500 ml |
| **Solution 5** | |
| Polyvinyl butyral | 86 g |
| Ethyl acetate | 4,300 ml |
| **Solution 6** | |
| Polyvinyl butyral | 290 g |
| Isopropanol | 3,580 ml |

Solution A was added to Solution 1 with vigorous stirring while the latter was being kept to a temperature of 85° C. in 10 minutes. Subsequently, Solution 2 was added to the mixture in 5 minutes. Thereafter, Solution 3 was added to the mixture in 25 minutes. The mixture was then stirred at the same temperature for 20 minutes. The mixture was then cooled to a temperature of 35° C. Solution 4 was then added to the mixture at a temperature of 35° C. while the mixture was being stirred more vigorously in 5 minutes. The mixture was then stirred at the same temperature for 90 minutes. Thereafter, Solution 5 was added to the mixture. The agitation was then suspended to allow the mixture to stand. The aqueous solution containing salts was removed to obtain an oil phase which was then desolvented to remove trace amounts of water. To the oil phase was then added Solution 6. The mixture was then vigorously stirred at a temperature of 50° C. The mixture was then stirred for 75 minutes to obtain Emulsion B.

Emulsion B thus prepared was then tested in the same manner as in Example 1 except that an antihalation layer was provided under the photosensitive layer on the photosensitive layer side of the support.

The samples according to the present invention provided results similar to Example 1.

As mentioned above, the heat-developable photographic light-sensitive material of the present invention can provide a high contrast image. Further, the heat-developable photographic light-sensitive material of the present invention can minimize the generation of fog and provide a high contrast when combined with the compound of formula (II).

While the invention has been described in detail and with reference to specific embodiments thereof, it will be apparent to one skilled in the art that various changes and modifications can be made therein without departing from the spirit and scope thereof.

What is claimed is:

1. A heat-developable photographic light-sensitive material comprising a support, a light sensitive layer comprising at least light sensitive silver halide, light insensitive silver source and reducing agent, and an optional light insensitive layer, said material further containing at least one compound represented by formula (I)

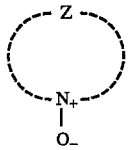

(I)

wherein Z represents a non-metallic atom group necessary for forming a nitrogen-containing heterocyclic group.

2. The heat-developable photographic light-sensitive material according to claim 1, wherein the material further contains at least one compound represented by formula (II)

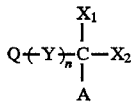

(II)

wherein Q represents an aryl group or a heterocyclic group; $X_1$ and $X_2$ each represent a halogen atom; A represents a hydrogen atom, a halogen atom or an electron-withdrawing group; Y represents —C(=O)— or —$SO_2$—; and n represents an integer of 0 or 1.

3. The heat-developable photographic light-sensitive material according to claim 1, which is a monosheet.

4. The heat-developable photographic light-sensitive material according to claim 1, which is adapted for infrared laser exposure.

5. The heat-developable photographic light-sensitive material according to claim 1, wherein the material contains said at least one compound represented by formula (I) in an amount of $10^{-4}$ to 1 mol/mol of Ag.

6. The heat-developable photographic light-sensitive material according to claim 2, wherein the material contains said at least one compound represented by formula (II) in an amount of $10^{-4}$ to 1 mol/mol of Ag.

7. The heat-developable photographic light-sensitive material according to claim 1, wherein the heterocyclic group formed by Z in formula (I) represents pyrrolidine, piperidine, piperazine, morpholine, pyrrole, imidazole, pyrazole, isothiazole, isoxazole, pyridine, pyrazine, pyrimidine, pyridazine, indolizine, triazole, triazine, indole, isoindole, indazole, purine, quinolizine, isoquinolizine, thiadiazole, oxadiazole, quinoline, phthalazine, naphthyridine, quinoxaline, quinazoline, cinnoline, pteridine, carbazole, phenanthridine, acridine, perimidine, phenanthroline, phenazine, phenothiazine, furazane, phenoxazine, tetrazole, thiazole, oxazole, benzimidazole, benzoxazole, benzthiazole, or indolenine.

8. The heat-developable photographic light-sensitive material according to claim 1, wherein the heterocyclic group formed by Z in formula (I) represents pyridine.

9. The heat-developable photographic light-sensitive material according to claim 1, wherein formula (I) is represented by formula (I-a)

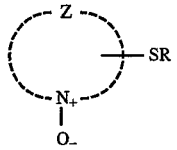

(I-a)

wherein Z represents a non-metallic atom group necessary for forming a nitrogen-containing heterocyclic group; and R represents a hydrogen atom, an aliphatic hydrocarbon group, an aryl group, a heterocyclic group or SR' in which R' represents an aliphatic hydrocarbon group, an aryl group or a heterocyclic group.

10. The heat-developable photographic light-sensitive material according to claim 1, wherein formula (I) is represented by formula (I-b)

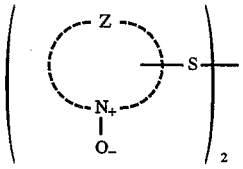

(I-b)

wherein Z represents a non-metallic atom group necessary for forming a nitrogen-containing heterocyclic group.

11. The heat-developable photographic light-sensitive material according to claim 1, wherein formula (I) is represented by formula (I-c)

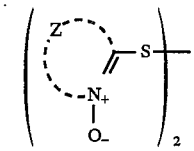

(I-c)

wherein Z represents a non-metallic atom group necessary for forming a nitrogen-containing heterocyclic group.

12. The heat-developable photographic light-sensitive material according to claim 2, wherein the heterocyclic group of Q in formula (II) is a 5- or 6-membered aromatic heterocyclic group.

13. The heat-developable photographic light-sensitive material according to claim 2, wherein the heterocyclic group of Q in formula (II) represents pyrrolidine, piperidine, piperazine, morpholine, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, and benthiazole.

14. The heat-developable photographic light-sensitive material according to claim 2, wherein formula (II) is represented by formula (II-a)

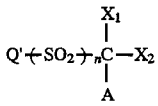

(II-a)

wherein Q' represents an aromatic nitrogen-containing heterocyclic group; $X_1$ and $X_2$ each represents a halogen atom; A represents a hydrogen atom, a halogen atom or an electron-withdrawing group; and n represents an integer of 0 or 1.

15. The heat-developable photographic light-sensitive material according to claim 2, wherein formula (II) is represented by formula (II-b)

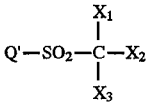

(II-b)

wherein Q' represents an aromatic nitrogen-containing heterocyclic group; $X_1$ and $X_2$ each represents a halogen atom; and $X_3$ represents a halogen atom.

16. The heat-developable photographic light-sensitive material according to claim 1, wherein the material further contains a reducible silver source, a photocatalyst, and a reducing agent for silver ion, and a binder.

17. The heat-developable photographic light-sensitive material according to claim 16, wherein the material further contains a color toning agent.

18. The heat developable photographic light-sensitive material according to claim 1, wherein said at least one compound represented by formula (I) is present in the light sensitive layer.

19. The heat developable photographic light-sensitive material according to claim 1, wherein said at least one compound represented by formula (I) is present in the light insensitive layer.

20. The heat developable photographic light-sensitive material according to claim 1, wherein the heterocyclic group formed by Z is substituted and the substituents are selected from the group consisting of an alkyl group, and alkenyl group, an alkinyl group, an aryl group, an amino group, an alkoxy group, an aryloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, sulfamoyl group, a carbamoyl group, an alkylthio group, an arylthio group, a sulfonyl group, a sulfinyl group, a ureide group, a phosphoric acid amide group, a hydroxyl group, a mercapto group, a halogen atom, a cyano group, a sulfo group, a carboxyl group, a nitro group, a hydroxamic acid group, a sulfino group, a hydrazino group, a disulfide group, and a heterocyclic group.

* * * * *